US012435901B2

(12) United States Patent
Davis et al.

(10) Patent No.: US 12,435,901 B2
(45) Date of Patent: Oct. 7, 2025

(54) CRITICAL AREA RECIRCULATION AND EXHAUST SYSTEM

(71) Applicant: Price Industries Limited, Winnipeg (CA)

(72) Inventors: Ethan Conrad Davis, Winnipeg (CA); Jordan Ashley Rose Enns, Winnipeg (CA); David Surminski, Winnipeg (CA)

(73) Assignee: Price Industries Limited, Winnipeg (CA)

( * ) Notice: Subject to any disclaimer, the term of this patent is extended or adjusted under 35 U.S.C. 154(b) by 491 days.

(21) Appl. No.: 17/900,451

(22) Filed: Aug. 31, 2022

(65) Prior Publication Data

US 2023/0083631 A1 Mar. 16, 2023

Related U.S. Application Data

(60) Provisional application No. 63/242,804, filed on Sep. 10, 2021.

(51) Int. Cl.

| | |
|---|---|
| ***F24F 13/06*** | (2006.01) |
| ***F24F 3/167*** | (2021.01) |
| ***F24F 7/06*** | (2006.01) |
| ***F24F 13/28*** | (2006.01) |

(52) U.S. Cl.

CPC ..... *F24F 13/06* (2013.01); *F24F 3/167* (2021.01); *F24F 7/065* (2013.01); *F24F 13/28* (2013.01); *F24F 2013/0616* (2013.01)

(58) Field of Classification Search

CPC .. F24F 13/06; F24F 3/167; F24F 13/10; F24F 2011/0005; A61G 10/02; E04H 3/08

USPC ..... 454/245

See application file for complete search history.

(56) References Cited

U.S. PATENT DOCUMENTS

| | | | | |
|---|---|---|---|---|
| 11,000,613 | B1 * | 5/2021 | Kellogg, Jr. | F24F 11/75 |
| 2006/0021375 | A1 | 2/2006 | Wetzel | |
| 2021/0356153 | A1 * | 11/2021 | Nesler | F24F 11/46 |
| 2023/0003414 | A1 * | 1/2023 | Searle | F24F 13/28 |

FOREIGN PATENT DOCUMENTS

| | | | |
|---|---|---|---|
| CN | 204084679 | | 1/2015 |
| CN | 211953169 | | 11/2020 |
| JP | S62172132 | | 7/1987 |
| KR | 20210030589 | A * | 9/2019 |
| KR | 20210062802 | A * | 6/2021 |

OTHER PUBLICATIONS

The Search Report issued by the Great Britain Intellectual Property Office on Mar. 7, 2023 for corresponding application No. GB2213218.7; 4 pages.

* cited by examiner

*Primary Examiner* — Allen R. B. Schult
*Assistant Examiner* — William C Weinert
(74) *Attorney, Agent, or Firm* — Smith Gambrell & Russell LLP

(57) ABSTRACT

A critical area recirculation and exhaust system for a room operates in a normal operating mode where fresh air is delivered from an air handler through a diffuser and returned to the air handler through a room return duct. In a selected isolation operating mode, a fan filter unit is activated to draw contaminated air from the room through one or more filters and to expel the filtered air through the diffuser and through an exhaust air duct to create an increased air change rate and a negative pressure in the room.

8 Claims, 5 Drawing Sheets

22
38
59
41
26
24
30
35
32
3,4
28

CRITICAL AREA RECIRCULATION AND EXHAUST SYSTEM

CROSS REFERENCE TO RELATED PATENT APPLICATIONS

This invention claims priority from U.S. Provisional Patent Application No. 63/242,804, filed Sep. 10, 2021, which is hereby incorporated by reference.

FIELD OF THE INVENTION

This invention relates to an air recirculation and exhaust system for a room in a care facility such as a hospital.

BACKGROUND OF THE INVENTION

In a hospital setting, patients, who are infectious and likely to transmit the infection to others, are typically assigned to a hospital room that is a negative pressure isolation room. Such a negative pressure isolation room should be capable of meeting the operational requirements of an Airborne Infectious Isolation Room as defined in the American Society of Heating, Refrigerating and Air-Conditioning Engineers (ASHRAE) Standard 170 (2021) including a negative pressure of at least 0.01 inches of water gauge (in.w.g.) and at least 12 air changes per hour (ACH).

Hospitals faced with a pandemic situation involving highly infectious patients may not have a sufficient number of negative pressure isolation rooms and may need to utilize standard hospital rooms with standard air distribution systems incapable of supplying negative pressure and incapable of supplying more than 4 ACH.

Consequently, there is a need to be able to selectively convert a standard hospital room into a negative pressure isolation room.

SUMMARY OF THE INVENTION

A critical area recirculation exhaust (CARE) system of the present invention when installed in an otherwise standard hospital patient room allows the hospital to selectively convert a standard hospital patient room to a negative pressure isolation room. The airflow system for a standard hospital room includes an air handler that supplies conditioned air to a flush-face radial flow diffuser for distribution of the conditioned air to the room. A room return air duct recirculates air from the room back to the air handler for conditioning.

The CARE system includes an airflow device that combines a fan filter unit with the one-way, flush-face radial flow diffuser to manage airflow for the hospital room. The CARE system further includes an exhaust air duct connected to an exhaust air outlet of the fan filter unit. The exhaust air outlet of the fan filter unit has a manually adjustable balancing damper to adjust the volume of airflow that is exhausted or recirculated when the CARE system is installed. The exhaust air duct has a controllable two position exhaust air duct damper that controls airflow from the fan filter unit to a location outside of the room. In addition, the CARE system has a controllable two position room return air duct damper in the room return air duct that controls airflow from the room back to the air handler. The CARE system also employs a room pressure sensor, a room pressure monitor/control panel, and a controller to activate a fan in the fan filter unit and to control the return air duct damper position and the exhaust air duct damper position.

The CARE system can switch between two operational modes by means of the monitor/control panel, the damper actuators, and the controller. The two operational modes are:

- Normal mode: fresh air is supplied to the room from an air handler through the room supply air duct and the flush-face radial flow diffuser of the airflow device, and the room air is removed from the room and returned to the air handler through the room return air duct with an open return air duct damper.
- Isolation mode: fresh air is supplied to the room from an air handler through the room supply air duct and through the flush-face radial flow diffuser of the airflow device. The room return air duct damper is closed, and room air is removed from the room through the fan filter unit of the airflow device. The fan filter unit of the airflow device draws contaminated air from the room and filters the air with a MERV 8 pre-filter and a HEPA filter. Part of the filtered air is mixed with the fresh supply air in the flush-face radial flow diffuser and returned to the room via flush-face radial flow diffuser, and part of the filtered air is exhausted out of the room through the exhaust air duct with exhaust air duct damper open to create a negative pressure environment within the room.

The capacity of the fan filter unit is sufficient to simultaneously increase the air change rate with recirculated airflow and create a negative room pressure by exhausting a portion of the filtered air.

Further objects, features and advantages will become apparent upon consideration of the following detailed description of the invention when taken in conjunction with the drawings and the appended claims.

DETAILED DESCRIPTION OF THE PREFERRED EMBODIMENTS

Figure 1:
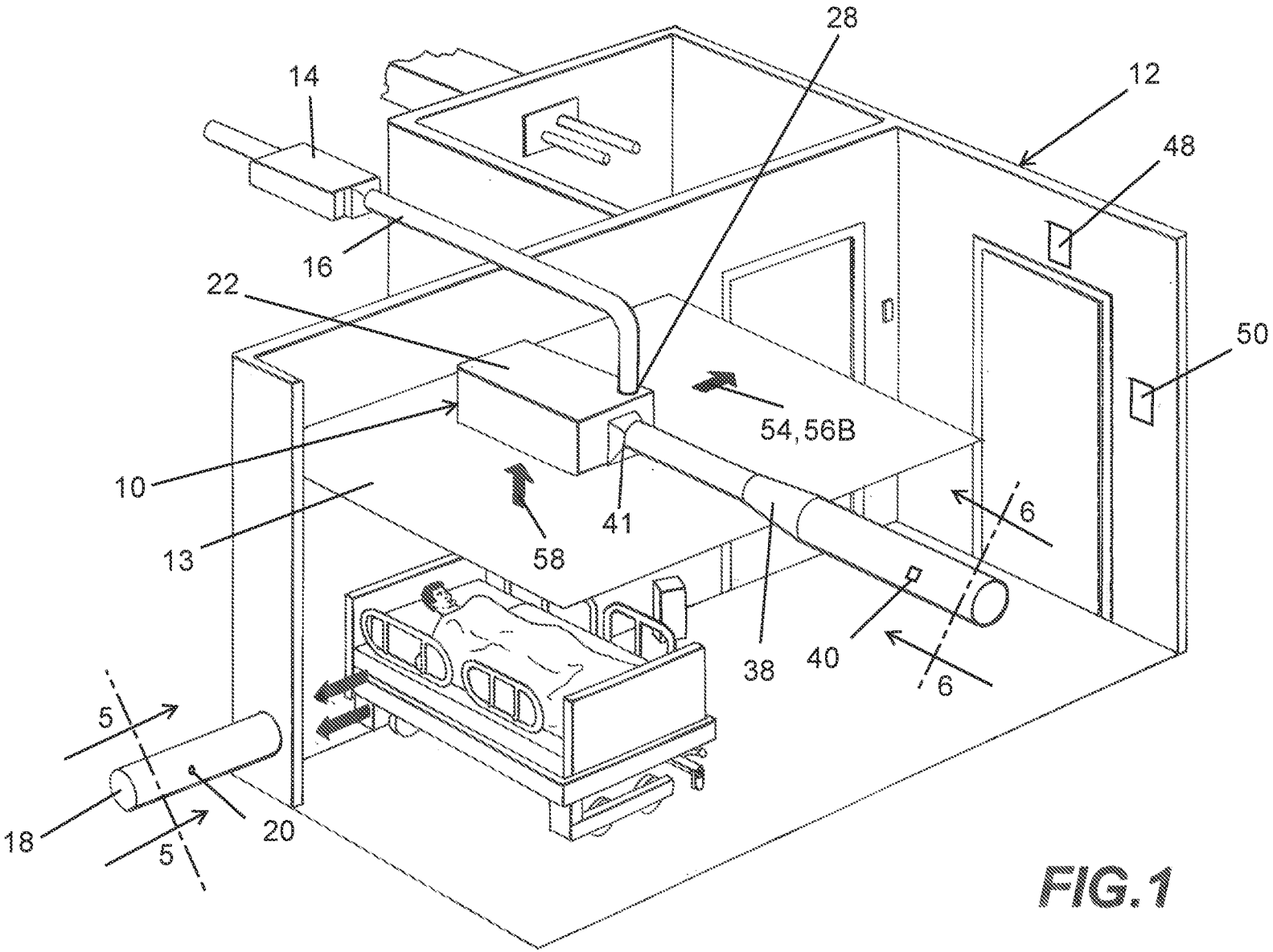
FIG. 1 is a perspective view of a hospital room in which a CARE system is installed in accordance with the present invention.

FIG. 1 shows the critical area recirculation and exhaust (CARE) system 10 installed in hospital room 12. The CARE system 10 includes an airflow device 22 flush mounted above a drop ceiling 13. The airflow device 22 manages airflow into and out of the hospital room 12. The CARE system 10 further includes an exhaust air duct 38 with a controllable two position exhaust air duct damper 40 to allow airflow out of the room 12 from the airflow device 22 when operating in the isolation mode. The room 12 also has a room return air duct 18 with a controllable two position room return air duct damper 20 to allow airflow out of the room 12 when operating in the normal mode.

The CARE system further employs a pressure sensor 48 for sensing the room pressure in the room 12 relative to the pressure in the corridor outside the room 12, a monitor/control panel 50, and a controller 52. The combination of the pressure sensor 48, the monitor/control panel 50, and the fan filter unit controller allows the room 12 to be switched from the normal operating mode to the isolation operating mode by selecting either the normal mode or the isolation mode on the monitor/control panel 50 as explained in greater detail below.

Figures 2A, 2B:
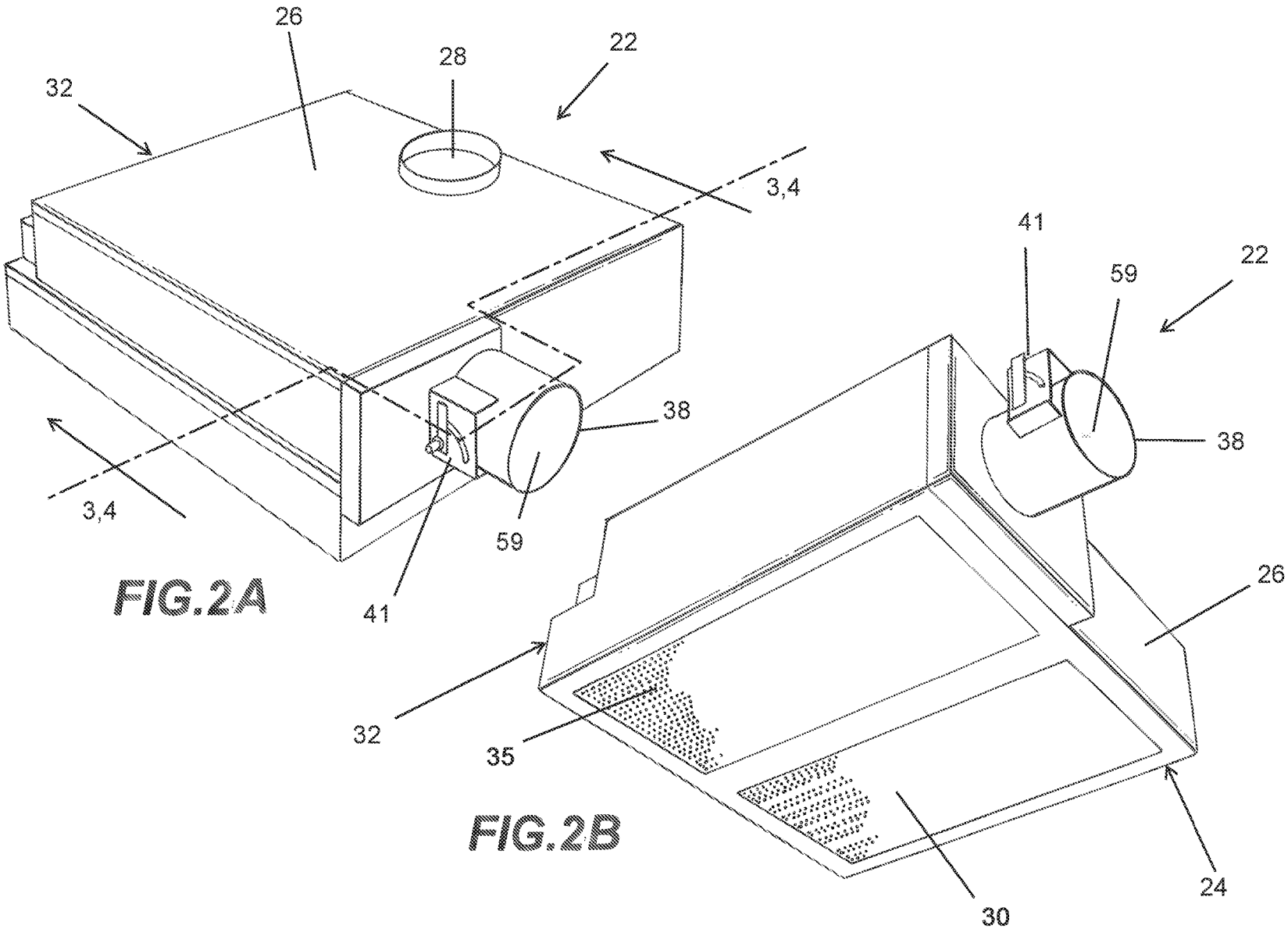
FIG. 2A is a top perspective view of an airflow device for the CARE system in accordance with the present invention.
FIG. 2B is a bottom (room-side) perspective view of the airflow device for the CARE system in accordance with the present invention.
Figure 3:
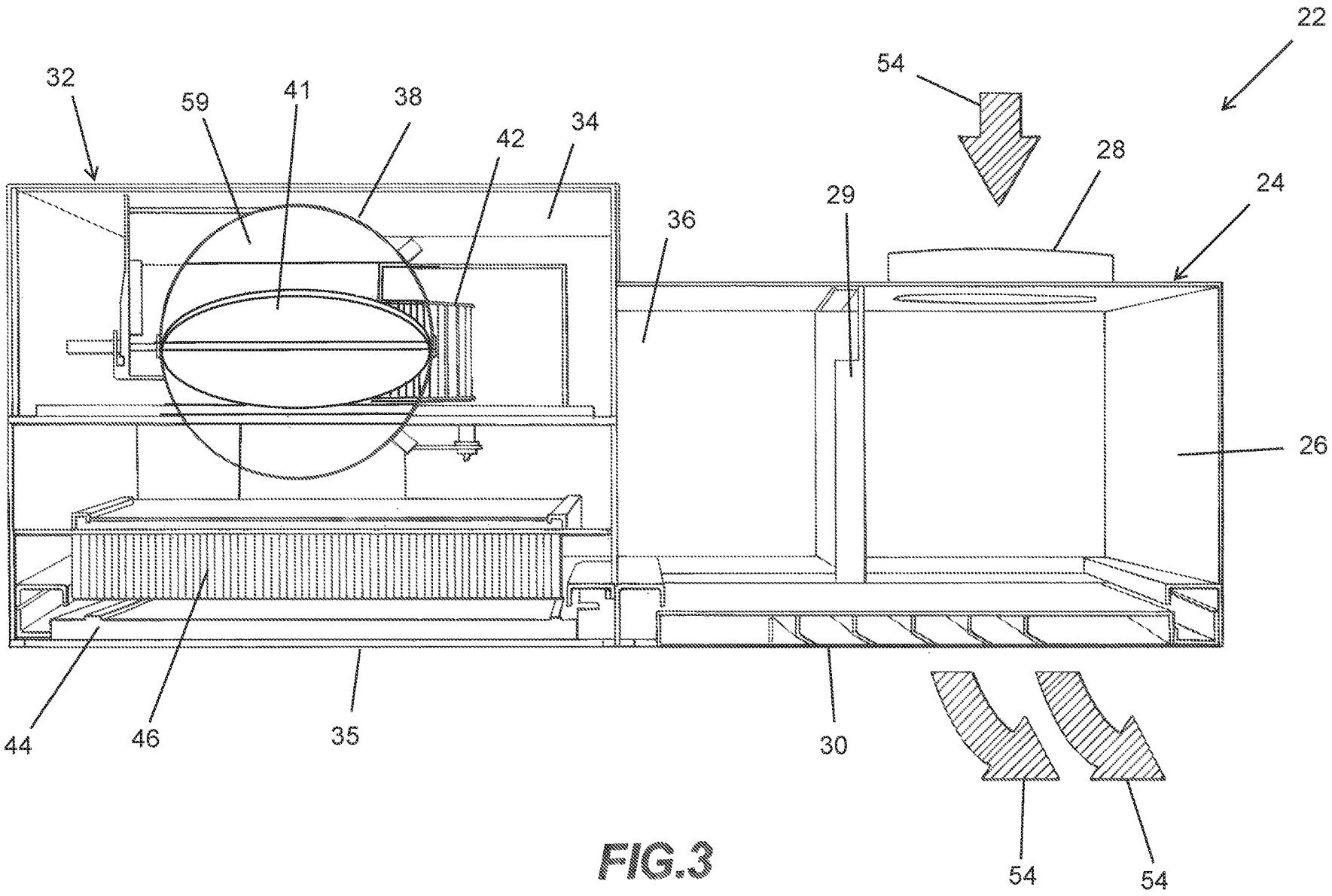
FIG. 3 is a section view of the airflow device for the CARE system as seen along line 3-3 of FIG. 2A and operating in the normal mode in accordance with the present invention.
Figure 4:
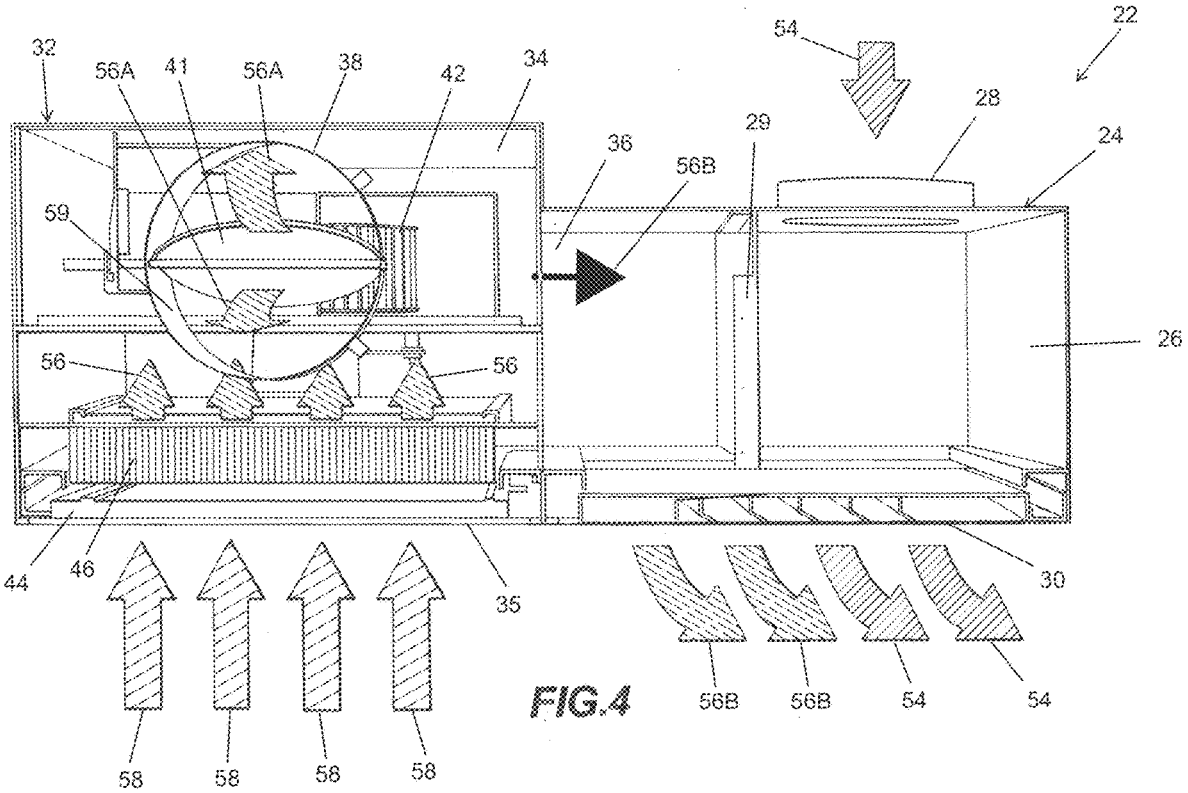
FIG. 4 is a section view of the airflow device for the CARE system as seen along line 4-4 of FIG. 2A and operating in the isolation mode in accordance with the present invention.
Figure 6:
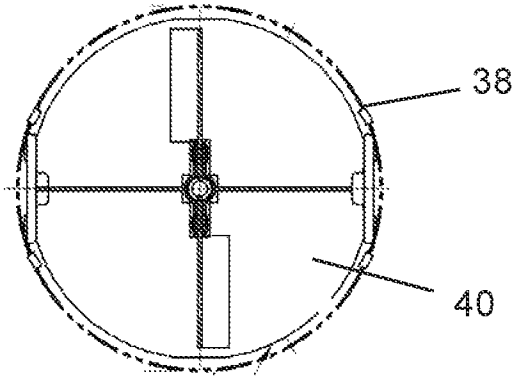
FIG. 6 is a section view of the exhaust air duct and the exhaust air duct damper of the CARE system as seen along line 6-6 of FIG. 2A when the damper is closed for operation in the normal mode in accordance with the present invention.
Figure 5:
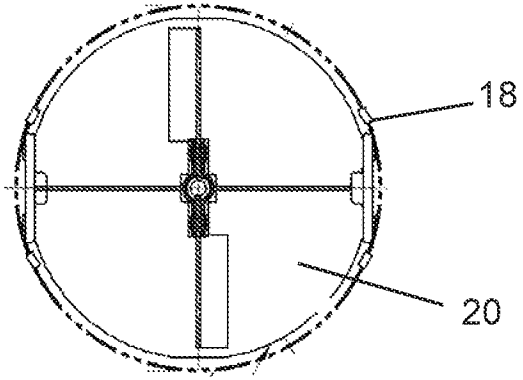
FIG. 5 is a section view of the room return air duct and the room return air duct damper of the CARE system as seen along line 5-5 of FIG. 1 when the damper is closed for operation in the isolation mode in accordance with the present invention.

The airflow device 22 includes a fan filter unit 32 and a flush-face radial flow diffuser 24 (FIGS. 2B, 3, and 4). The fan filter unit 32 has a fan 42 mounted within a fan filter unit chamber 34. The chamber 34 includes a return air inlet 35 for receiving contaminated room air 58 drawn into the chamber 34 by the fan 42. The return air inlet 35 includes a minimum efficiency reporting values (MERV) 8 pre-filter 44 and a high efficiency particulate air (HEPA) filter 46. Both the MERV 8 pre-filter 44 and the HEPA filter 46 are serviceable from the room side of the airflow device 22. The chamber 34 has an exhaust air outlet 59 with a manually adjustable balancing damper 41. During initial set up, the balancing damper 41 is set to meter and thereby balance airflow when the downstream exhaust air duct damper 40 is open for operation in the isolation mode. When the exhaust air duct damper 40 is open, the exhaust air duct 38 allows filtered air 56 to be exhausted to a location outside of the room 12. An air passage 36 connects the fan filter chamber 34 to the diffuser housing 26 of the flush-face radial flow diffuser 24. The air passage 36 allows filtered air 56B to pass to the diffuser housing 26 and then to the room 12 through the radial air outlet 30.

The diffuser housing 26 of the flush-face radial flow diffuser 24 has an air supply inlet 28. The air supply inlet 28 receives conditioned air from an air handler 14. Air supplied to the diffuser housing 26, either conditioned air from the air handler 14 or filtered air 56B from the fan filter unit 32, exits the diffuser 24 through the radial air outlet 30. The radial air outlet 30 directs the air along the drop ceiling 13. By directing the air along the drop ceiling 13, the airflow device 22 prevents short-circuiting of airflow from the air outlet 30 of the flush-face radial flow diffuser 24 to the return air inlet 35 of the fan filter unit 32. The horizontal flow of the air (56B and 54) from the flush-face radial flow diffuser 24 in conjunction with the high airflow rate of the airflow device 22 helps increase dilution of the air in the room 12 while maintaining occupant comfort.

FIG. 3 shows the airflow device 22 operating in the normal operating mode. In the normal operating mode, conditioned air is supplied from the air handler 14 through the air supply inlet 28 to the diffuser housing 26 of the flush-face radial flow diffuser 24. The conditioned air is expelled from the diffuser housing 26 through the radial air outlet 30 into the room 12. Air from the room 12 is then returned to the air handler 14 through the room return air duct 18 with the room return air duct damper 20 open. The diffuser housing 26 has a baffle 29 to prevent back flow of supply air 54 into the fan filter unit 32 during the normal operating mode and reduces back pressure between the fan 42 of the fan filter unit 32. During the normal operating mode, the fan 42 is turned off, the exhaust air duct damper 40 of the exhaust air duct 38 is closed, and the room return air duct damper 20 of the room return air duct 18 is open.

FIG. 4 shows the airflow device 22 operating in the isolation operating mode. In the isolation operating mode, the room return air duct 18 is closed by means of room return air duct damper 20 and the exhaust air duct 38 is open by means of exhaust air duct damper 40. The fan 42 of the fan filter unit 32 is turned on and draws contaminated room air 58 from the room 12 into the fan filter chamber 34 through the return air inlet 35 and through the MERV 8 pre-filter 44 and the HEPA filter 46. The MERV 8 pre-filter 44 removes larger particulate from the airstream, and then the HEPA filter 46 removes 99.99% of contaminants. Part of the filtered air 56, identified as filtered air 56A, in the fan filter chamber 34 is forced through the exhaust air outlet 59 and through exhaust duct 38 with open exhaust air duct damper 40 to a location outside of the room 12. Another part of the filtered air 56, identified as filtered air 56B, in the fan filter chamber 34 is forced through the passage 36 into the diffuser housing 26 where the filtered air 56B is mixed with the supply air 54. The mixed filtered air 56B and the supply air 54 then exits the flush-face radial flow diffuser through the radial air outlet 30. The fan speed is sufficient to exhaust filtered air 56A to a location outside of the room and to provide the necessary air changes in the room and to negatively pressurize the room. While a total of 12 air changes per hour (ACH) is generally required for a hospital room servicing highly infectious patients, the air handler 14 is generally capable of providing 4 ACH thereby requiring the fan filter unit 32 to provide an additional 8 ACH for a total of the required 12 ACH.

In order to convert the room 12 from the normal operating mode described above to isolation operating mode, an authorized person accesses the monitor/control panel 50 and selects the isolation mode of operation. An instruction is issued by the monitor/control panel 50 to damper actuators, which in turn closes the room return air duct damper 20 (FIG. 1) and opens the exhaust air duct damper 40 (FIG. 4). In addition, the fan filter unit controller activates fan 42 in the fan filter unit 32. The pressure sensor 48 monitors the pressure in the room 12 and issues an alarm signal if the measured pressure deviates from the pressure set point of at least 0.01 in.w.g.

During installation of the CARE system, the motor for the fan 42 and a balancing damper 41 are set for a constant airflow during the isolation operating mode. The constant flow fan 42 assures that airflow through the airflow device remains constant during changing conditions within the room during the isolation operating mode. In case of a failure during the isolation operating mode, the room return air duct damper 20 is mechanically biased to its closed position to assure that contaminated air cannot escape from the room into the air handler 14 of the heating and ventilation system. In addition, the exhaust air duct damper 40 is mechanically biased to its open position so that contaminated air within the room can safely escape from the room.

While this invention has been described with reference to preferred embodiments thereof, it is to be understood that variations and modifications can be affected within the spirit and scope of the invention as described herein and as described in the appended claims.

We claim:

1. A critical area recirculation and exhaust system for a room comprising:

a. an air handler connected to a room supply air duct for providing room supply air to an airflow device;

b. a room return air duct for receiving air from the room and returning the air to the air handler;

c. the airflow device comprising:

i. a diffuser with a diffuser housing and having:

(a) an air supply inlet for receiving supply air from the air handler through the room supply inlet into the diffuser housing;

(b) an air outlet for delivering air from the diffuser housing to the room; and ii. a fan filter unit having:

(a) a chamber connected to the diffuser housing and including an air passage between the chamber and the diffuser housing;

(b) a return air inlet for receiving contaminated air from the room;

(c) an exhaust air outlet from the chamber;

(d) a filter positioned between the return air inlet and the chamber; and (e) a fan for drawing air from the room through the room air inlet into the chamber and expelling air either through the passage to the diffuser housing or through an exhaust air duct;

d. the exhaust air duct connected to the exhaust air outlet and having an exhaust air duct damper, the exhaust air duct configured for receiving air from the exhaust air outlet and exhausting air in the chamber to a location outside of the room; and e. a room return air duct damper for the room return air duct, wherein in a normal operating mode, the room return air duct damper is open, the exhaust air duct damper is closed, and the fan in the fan filter unit is deactivated; and wherein in an isolation operating mode, the room return air duct damper is closed, the exhaust air duct damper is open, and the fan of the fan filter unit is activated to draw contaminated air from the room through the filter of the fan filter unit and expel the filtered air into the diffuser and through the exhaust air duct in order to create a negative pressure in the room.

2. The critical area recirculation and exhaust system of claim 1, wherein the system further includes a monitor/control panel operatively connected to a controller and wherein in response to input on the monitor/control panel the controller switches the system between the normal operating mode and the isolation operating mode.

3. The critical area recirculation and exhaust system of claim 2, wherein the system further includes a pressure sensor operatively connected to the controller and wherein the pressure sensor monitors the pressure in the room to assure a negative pressure in the room.

4. The critical area recirculation and exhaust system of claim 3 wherein during the isolation operating mode the critical area recirculation exhaust system creates the negative pressure in the room of at least 0.01 inches of water gauge (in.w.g.) and produce at least 12 air changes per hour (ACH).

5. A method of selectively converting a standard room to a negative pressure isolation room, the method comprising:

a. operating the room in a normal operating mode by:

i. supplying air to the room from an air handler through a room supply air duct and a diffuser; and ii. returning air within the room to the air handler through a room return air duct; and b. converting the room to an isolation operating mode by:

i. continuing to supply air to the room from the air handler through the room supply air duct and the diffuser;

ii. preventing air within the room from returning to the air handler; and iii. exhausting air from the room in order to create a negative pressure within the room, and wherein the contaminated air is filtered in the airflow device and wherein part of filtered air is mixed with conditioned air and part of the filtered air is exhausted from the room.

6. The method of claim 5, wherein during the isolation operating mode, an airflow device extracts contaminated air from the room at a constant airflow rate and exhausts air from the room to create a negative pressure within the room of at least 0.01 inches of water gauge (in.w.g.) and produce at least 12 air changes per hour (ACH).

7. A method for retrofitting a room to operate in an isolation operating mode with a negative pressure in the room, wherein the room has a room supply air duct for supplying conditioned air from an air handler to the room through a diffuser with a diffuser housing and a room return air duct for conducting air from the room back to the air handler, the retrofitting method comprising the steps of:

a. providing a room return air duct damper in the room return air duct;

b. providing an exhaust air duct with an exhaust air duct damper for exhausting air to a location outside of the room;

c. installing a fan filter unit connected to the diffuser comprising:

i. a chamber connected to the diffuser housing and including an air passage between the chamber and the diffuser housing;

ii. a return air inlet for receiving contaminated air from the room;

iii. a filter positioned between the return air inlet and the chamber; and iv. a fan for drawing air from the room through the room air inlet into the chamber and expelling air either through the passage to the diffuser housing or through an exhaust air outlet connected to the exhaust air duct; and d. installing a monitor/control panel and a controller, wherein based on instructions input from the display/control panel, the controller converts the room from the normal operating mode to the isolation operating mode by closing the room return air duct damper, opening the exhaust air duct damper, and activating the fan.

8. The retrofitting method of claim 7, wherein the retrofitting method further includes installing a balancing damper in the exhaust air duct located upstream from the exhaust air duct damper and installing a fan motor to maintain a constant airflow through the balancing damper.

* * * * *